US005545082A

United States Patent [19]

Courson et al.

[11] Patent Number: 5,545,082

[45] Date of Patent: Aug. 13, 1996

[54] DUST CONTROL SYSTEM FOR ROTARY HAND TOOLS

[76] Inventors: Michael W. Courson, 1088 Thunderbird, El Paso, Tex. 79912; Daniel C. Courson, 12806 Traviata, Houston, Tex. 77024; William H. Courson, 1088 Thunderbird, El Paso, Tex. 79912

[21] Appl. No.: 240,971

[22] Filed: May 2, 1994

[51] Int. Cl.[6] ..... B24B 55/06

[52] U.S. Cl. ..... 451/456; 451/359

[58] Field of Search ..... 451/344, 358, 451/359, 451, 452, 454, 455, 456; 30/284, 285, 286

[56] References Cited

U.S. PATENT DOCUMENTS

| | | | |
|---|---|---|---|
| 883,920 | 4/1908 | Stoll | 451/451 |
| 2,707,854 | 5/1955 | Johnson | 451/451 |
| 2,819,570 | 1/1958 | Tocci-Guilbert et al. | 451/451 |
| 3,826,045 | 7/1974 | Champayne | 451/359 |
| 3,849,088 | 11/1974 | Johansson | 451/452 |
| 3,882,644 | 5/1975 | Cusumano | 451/359 |
| 4,145,848 | 3/1979 | Hutchins | 451/359 |
| 4,574,532 | 3/1986 | Haberle et al. | 451/451 |
| 5,125,190 | 6/1992 | Buser et al. | 451/359 |

*Primary Examiner*—Bruce M. Kisliuk
*Assistant Examiner*—Thomas W. Lynch
*Attorney, Agent, or Firm*—John R. Duncan; Frank D. Gilliam

[57] ABSTRACT

A system for removing dust generated by rotary hand tools such as grinders and sanders. A shroud is installed over the grinding or sanding head in communication with a vacuum exhaust system to draw away dust, chips and the like. The shroud includes a generally circular base having a peripheral skirt on one side to surround the grinding or sanding disc and a collar arrangement on the other for attachment to a cylindrical tool housing. The collar may be an axial partial tube section that is clamped to the housing. Collar flexibility allows use with housings over a range of housing diameters. Alternatively, the collar may be one or more brackets slidably mounted on the base. The brackets are adjusted to contact the housing and are clamped to the housing and, if necessary, are fastened to the base. Removable and adjustable exhaust tubes are provided to accommodate different desired vacuum hose directions and different vacuum hose diameters.

21 Claims, 3 Drawing Sheets

DUST CONTROL SYSTEM FOR ROTARY HAND TOOLS

BACKGROUND OF THE INVENTION

This invention relates in general to the control of particles and dust generated by rotary tools and, more particularly to a dust collecting shield for rotary sanders and the like.

Rotary hand tools, such as grinders, pad sanders, flap sanders, tuck pointing blades etc. generate a considerable quantity of particles and fine dust from the object being ground or sanded and from the sanding media itself. Grinders and sanders may be used with such materials as fiberglass, metal, wood, plastics, carbon fibers, and the like. The fine particulate material generated may be a health hazard to the operator and those in the vicinity. Wood dust and hot metal particles can be a fire hazard. Particles of the material being ground and occasionally small pieces of the grinding or sanding media may be ejected at high velocity under centrifugal forces.

A large variety of different shields have been developed for controlling dust and chips produced by hand-held rotary grinding, sanding, carving and polishing machines using an abrasive disc, pad or other shape. Many use a circular bowl-shaped housing surrounding the rotating disc, held to the tool by a clamp, bolt, etc., as exemplified by the shields described by Buser et al. in U.S. Pat. No. 5,125,190 and Isakson in U.S. Pat. No. 3,862,521. Generally, a tube is secured in communication with the shield interior to permit connection of a vacuum system for drawing off dust.

While effective for containing and removing dust during simple operations, such as surface grinding or sanding, these shields have a number of problems.

With prior shields it is difficult or impossible to fit a wrench to the arbor section of the tool to change the abrasive disc without first removing the shield. This is very inconvenient, in particular where a series of abrasive discs using gradually finer grit are to be used in finishing a surface.

Most prior shields are a one piece molding or fabricated shield combining a base, a skirt extending from the base around the abrasive disc and a collar or other means for attachment to the tool. Because of this, a separate and distinct shield assembly must be provided for every abrasive disc diameter or backing pad thickness and for every different sanding tool collar size. Distributors of such shields must maintain a large inventory of different size shield assemblies, requiring large amounts of retail floor space and stockroom space, and a large capital investments to stock a complete selection of products. The consumer must be very carefully to obtain a shield that matches his tool by make and model.

One-piece shield designs must use materials having strength and rigidity optimized for the most highly stressed portion of the shield. This limits the flexibility that is highly desirable in some areas, in particular the collar to shield base region to permit the shield skirt and base to flex slightly.

Prior shield designs have a fixed exhaust tube fastened to and communicating with the interior of the shield for connection to a vacuum system. Typically, the exhaust tube is connected through the shield base, as shown by Matechuk in U.S. Pat. No. 4,782,632 or tangentially to the shield skirt, as shown by Rudiger in U.S. Pat. No. 4,135,334. While effective for many purposes, the fixed exhaust tubes often require the use of adapters for connection to vacuum hoses of different diameters or will require a series of different complete shield assemblies for use with different vacuum systems. Also, the location of the fixed exhaust tube may make use by left-handed persons or use in some applications difficult with prior lightweight, one-piece, flexible shields. Where the vacuum hose to be used is large or heavy, the weight of the hose may pull on the shield, distorting the shape of the shield skirt and reduce dust collection efficiency.

In most cases a clear plastic skirt is preferred to allow observation of operation through the shield. Where sanding metal, plastic may have insufficient strength and resistance to flying metal particles, requiring the use of a metal base and skirt.

Prior shield systems are optimized for use with one, or a small range, of abrasive disc designs. When a different disc design is used, the entire shield must be replaced. Distributors must maintain separate inventories of shields for use with surface sanders, requiring a full circular shield, and shields for use with flap sanders, tuck pointing discs and the like that require a side opening of a particular width. In addition, when using a conventional abrasive disc shield for edge sanding, dust and other particles on the side of the disc opposite the work being abraded are not captured.

Thus, there is a continuing need for improvements in dust control systems for rotary abrasive tools that permit one shield assembly to be used with a variety of tools having different shaft housing diameters and with a variety of abrasive discs and the like, that allow the use of different materials in the collar and shield base/skirt areas and different collar designs and materials to permit a selected degree of shield flexibility in use, that permit the use of a variety of exhaust tube diameters, locations and vacuum hose support arrangements, that are adaptable to use with both surface abrading and side abrading systems and capture dust from the top and bottom surfaces of a side abrading system, and that allow the use of shield components of different materials with different resistance to particle impact and that permit use of one shield with a variety of abrasive disc systems.

SUMMARY OF THE INVENTION

The above-noted problems, and others, are overcome in accordance with this invention by a dust control system for rotary hand tools which basically comprises a substantially circular shroud having a generally circular base with a peripheral skirt adapted to surround a rotatable tool on a shaft extending from a housing, a central opening in the base through which the rotatable tool shaft can pass from the tool into the area surrounded by the skirt, a collar assembly secured to the base opposite the skirt, the collar capable of contacting portions of the periphery of housings of different widths and means, such as a hose clamp or the like, for securely fastening the collar to the housing.

Several different embodiments of the collar may be used to adapt to housings of different diameter. In one embodiment, the collar is a tube section sized to extend from about 30° to 240° around the housing. The partial tube is formed from a selected material that has sufficient flexibility to conform to varying housing diameters within a selected range, when the tube section collar is clamped against the housing with a hose clamp or the like. The tube section is preferably formed from a flexible plastic such as an acrylic, styrene, polycarbonate, polypropylene material and mixtures and combinations thereof. One material that is particularly useful in many applications is a rubbery plastic available under the designation Sterion from Firestone. The tube section is preferably mechanically or adhesively bonded to the shroud base, or integrally formed with the base by injection molding. If desired, a plurality of small reinforcement members or gussets may be bonded (or molded during forming of the other components) between the tube section and the base to reinforce the bond between tube and base.

In another embodiment, the attachment collar means may include one or more brackets slidably secured to the base for movement toward and away from the center of the base. With one or two brackets, the brackets are positioned in contact with the housing and the brackets are secured to the base by any suitable means, such as setscrews, adhesive bonding, etc., then the brackets are secured to the housing, such as with a hose clamp. With three or more brackets, the housing is centered on the base, the brackets are moved into contact with the housing and clamped to the housing. In this case the brackets are inherently self-centering, so they need not be rigidly fastened to the base.

while the vacuum exhaust port may penetrate either the base or the skirt portion of the shroud, in many cases a means for releasably securing an exhaust tube over an exhaust port opening in the skirt is preferred, so that different tubes having different diameters, oriented at different angles to the shield, including means for supporting the vacuum hose, etc. may selectively be used. In the case of an exhaust tube connected to a port through the base, a swiveling angled exhaust extension can be fitted over the exhaust tube so that the vacuum hose can be oriented in a convenient direction.

The skirt and base may be provided with one or more weakened lines in planes parallel to the shield centerline at selected distances from the centerline. The portion of the base and skirt outside a selected line can be broken away, so that an edge abrading disc such as a wire brush, flap wheel, side buffing wheel or tuck point cutting blade may be used. In order to collect dust from both sides of such an edge abrading disc, a cover plate is preferably attachable covering the open side of the skirt. The cover has weakened lines corresponding to the lines in the base and skirt so that an outer corresponding portion can be removed. Any suitable means may be used to releasably secure the cover to the skirt, such as a releasable adhesive, tape, hook-and-loop fasteners of the sort available under the "Velcro" trademark, a cooperating edge bead and recess means or the like. Best results are obtained with the cooperating edge bead and recess arrangement.

If desired, a thin fiber brush, a foam or rubbery lip, or other soft material may be provided along the edge of the skirt to allow further edge flexibility and greater sealing with the workpiece.

Thus, it is apparent that the shield of this invention is extremely versatile, adaptable to a variety of abrading tools.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
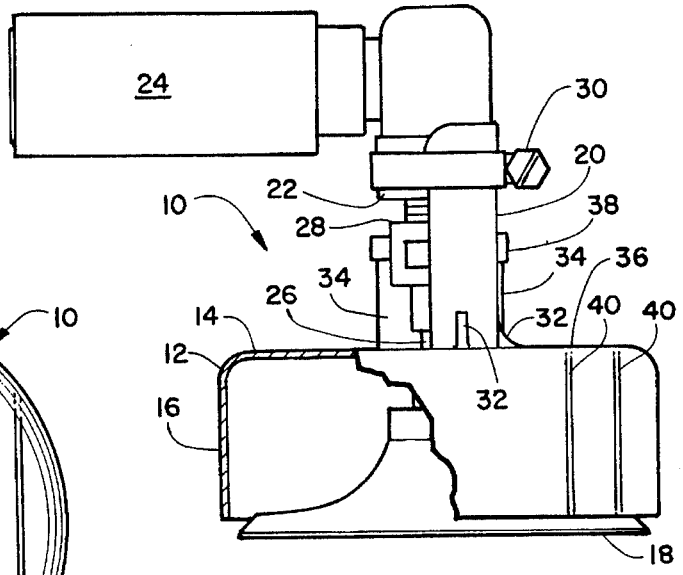
FIG. 1 is an elevation view, partially cut-away, of a first embodiment of the dust control system on a surface sander.
Figure 2:
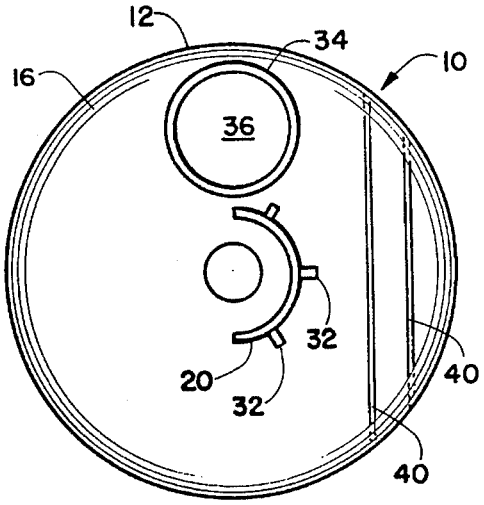
FIG. 2 is a plan view of the shield shown in FIG. 1.

Referring to FIGS. 1 and 2, there is seen a schematic elevation view of a first embodiment of the dust control shield 10 of this invention. A generally bowl-shaped shroud 12 made up of a base 14 and skirt 16 is sized to fit around a conventional sanding or grinding tool backing pad and abrasive disc 18. Base 14 and skirt 16 are preferably round, although other shapes could be used, if desired. Base 14 and skirt 16 are preferably shaped or molded from a single piece of material, although they could be fabricated from multiple pieces, if desired. In most cases, a transparent material, such as a polycarbonate resin, is preferred for shroud 12 to allow the tool 18 to be observed in use. Where metal is being ground, and high temperatures are being created and hot chips or particles are impacting the interior of skirt 16, a metal skirt may be preferred.

A collar 20 is secured to base 14. Collar 20 is a tube section, cut along a plane parallel to the tube centerline. A tube section extending from about 30° to 240° around the tube centerline is preferred. The tube from which collar 20 is cut has an inside diameter reasonably similar, but not necessarily identical to, to the diameter of housing 22 on sander 24 that surrounds and houses the tool arbor 28 and the shaft 26 of tool 18. A conventional arbor 28 releasably locks shaft 26 to sander 24. Arbor 28 is operated by a conventional key, spanner wrench or the like to release and lock shaft 26 in place.

Collar 20 is formed from a flexible plastic, light metal, etc. A clamp means, such as a conventional hose clamp 30 surrounds the upper end of collar 20 to clamp the collar against housing 22. The flexibility and limited circumference of collar 20 allows it to be clamped tightly against housings having diameters somewhat larger or smaller than the inner diameter of the collar. If desired a layer of resilient material, such as rubber, leather or the like, could be used on the interior of tube section 20 to aid in holding the shield in place. Also, the open side of collar 20 permits a conventional wrench (not shown) to operate arbor 28 to change tool 18 without removing shield 10. In order to reinforce the collar 20 to base 14 intersection, several gusset-type reinforcements 32 may be provided between collar and base.

An exhaust tube 34 is secured, such as by a snap in place or bayonet connection or adhesive or thermal bonding, to base 14 around an exhaust port 36 through base 14. If desired, the entire shield, including collar 20 and exhaust tube 34 could be formed as in integral unit by injection molding. A conventional vacuum hose 38 is slipped over tube 34 to connect shield 10 to a conventional vacuum system (not shown) for withdrawing air, dust, chips, etc from within the shield. While not ordinarily necessary, a clamp similar to clamp 30 may be provided to hold hose 38 in place over exhaust tube 34.

One or more weakened lines 40 are preferably provided in base 14 and skirt 16 in planes substantially parallel to the centerline of shield 10. These may be shallow, narrow grooves either formed when shroud 12 is molded or cut mechanically thereafter. These weakened lines 40 allow portions of an edge of shield 14 to be easily, cleanly and precisely removed where an edge grinding or sanding tool is used, as detailed below.

As shown in FIG. 1, tool 18 extends slightly below the edge of skirt 16. The tool surface may be aligned exactly with the skirt edge, or may be caused to extend a greater distance, as desired, simply by choosing the location along housing 22 at which collar 20 is secured by clamp 30. The location of the plane of the tool relative to the plane of the skirt edge can be easily adjusted by moving collar 20 up or down along housing 22, then clamping the collar in place.

Figure 3A:
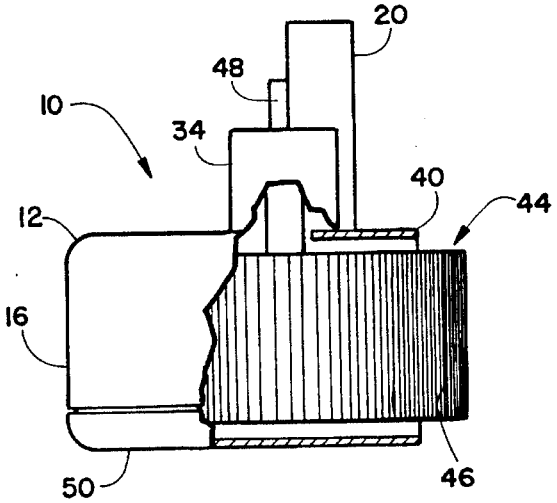
FIG. 3A is an elevation view, partially cut away, of a second embodiment involving an edge abrading system with the outer skirt section removed.
Figure 3B:
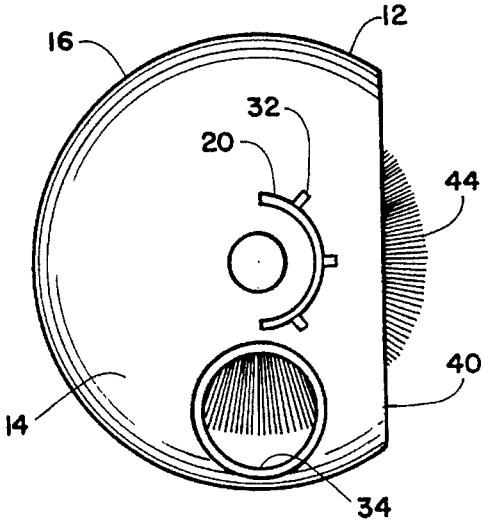
FIG. 3B is a plan view of the embodiment of FIG. 3A

FIGS. 3A and 3B show a second embodiment of shield 10, in this case optimized for use with an edge grinding or sanding tool. In the embodiment shown, a "flap sander" 44 having a plurality of sheets of sandpaper 46 or the like extending out from shaft 48 to "flap" against an object and gently but evenly sand an object brought into contact with the sander. The edge portions of base 14 and skirt 16 have been removed along weakened line 40 (of the sort shown in FIGS. 1 and 2) to allow flap sander 44 to extend out the side of the shield.

Since the lower surface of flap sander 44 is not in contact with a surface as would be the case with the surface sander or grinder 18 seen in FIGS. 1 and 2, it is preferred that a removable cover 50 be provided for the open side of skirt 16. Cover 50 conforms in shape to that of shield 10, with weakened lines matching those provided in shield 10, so that an edge portion can be broken away to match the opening in shield 10. Cover 50 can be fastened to skirt 16 in any suitable manner, such as a releasable adhesive, tape or, in the most preferred embodiment, by an interlocking edge.

Figure 3C:
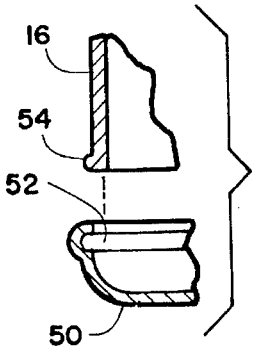
FIG. 3C is a detail view of the skirt to cover connection in FIG. 3A and FIG. 3B.

A snap-together interlock as shown in FIG. 3C, with a peripheral groove in the inner edge of cover 50 matching a bead 54 around the outer periphery of skirt 16 is preferred. This interlock can be easily snapped together, then removed by bending the open edges of the cover slightly inwardly and snapping them apart.

Other edge abraders can be used with the shield embodiment of FIG. 3A, such as wire brushes, buffing wheels and tuck point blades.

Figure 4A:
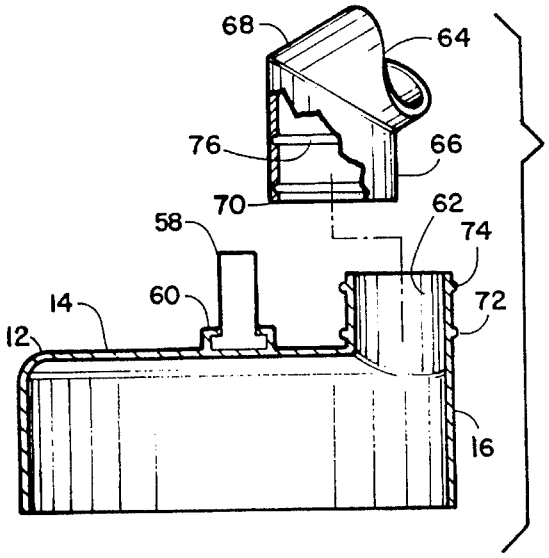
FIG. 4A is an elevation view of a third embodiment having an adjustable collar bracket attachment arrangement and an exchangeable swiveling outlet port.
Figure 4B:
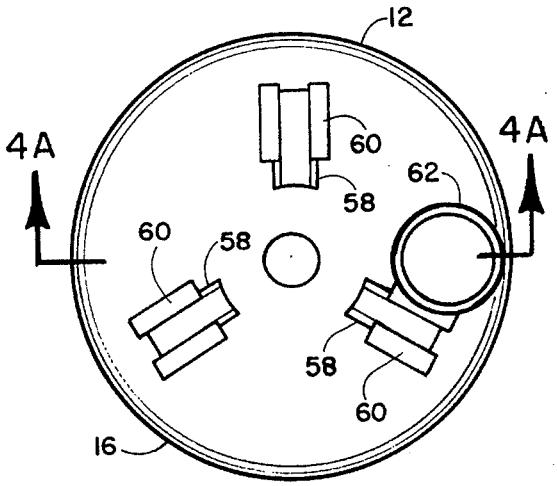
FIG. 4B is a plan view of the embodiment of FIG. 4A.

FIGS. 4A and 4B show another embodiment of dust control shield 10. As with the other embodiments, shield 10 basically includes a base 14 and a skirt 16.

A plurality of brackets 58 each slidable in a channel 60 toward and away from the centerline of the shield are provided for securing the shield to a sander housing 22 (as seen in FIG. 1). While three brackets 58 as shown is a preferred arrangement, in some cases, especially with a square housing, four brackets are preferred, although more or fewer brackets 58 may be used. Where fewer than three are used, provision must be made to lock the bracket to the corresponding channel 60, such as with setscrews, at the desired location. With three or more brackets 58, the group of brackets will be inherently self-centering, so that no means for fastening a bracket to its channel will be required, although a fastener such as setscrews could be used if desired. In use, the shield is positioned in alignment with the grinder or sander housing and the brackets 58 are moved into contact with the housing in the desired alignment. A clamp (not shown), such as a conventional hose clamp, is then tightened around the brackets to secure the shield to the housing.

In the embodiment shown in FIGS. 4A and 4B, another vacuum outlet embodiment is also depicted. Exhaust tube 62 communicates with an exhaust port (not seen) through base 14. A swiveling exhaust extension 64 has a base section 66 having an inside diameter slightly greater than the outside diameter of exhaust tube 62. The angled end 68 of extension has any suitable diameter, selected to match the vacuum hose to be used with this shield.

A first circumferential groove 70 around tube 62 cooperates with a molded bead 72, and second circumferential groove 74 cooperates with a bead 76, each around the inside of base section 66. Extension 66 is slipped over exhaust tube 62 so that the inner wall sealingly engages groove 70 with molded bead 72 and bead 76 snaps into groove 74. Extension 64 then can be swiveled to keep a vacuum hose connected to angled end 68 out of the way of the operator, while the beads and grooves prevent air from being drawn between tubes 62 and 66. Extension 64 may be easily replaced with another having a different diameter at angled end 68 to fit a different vacuum hose. Engagement means other than the cooperating beads and grooves may be used, if desired. In many cases, tube 62 will be sized so that a conventional vacuum hose end can fit snugly over or within tube 62.

Thus, the embodiment of FIGS. 4A and 4B will fit a large variety of grinders and sanders, having varying collar mount diameters and can be easily adapted to a variety of vacuum hose diameters and hose connection angles relative to the tool and the tool operator. A retailer would not be required to keep a large number of different shields on hand to accommodate different sander and vacuum systems. The user would be able to use a single shield assembly on a number of different tools.

Figure 5:
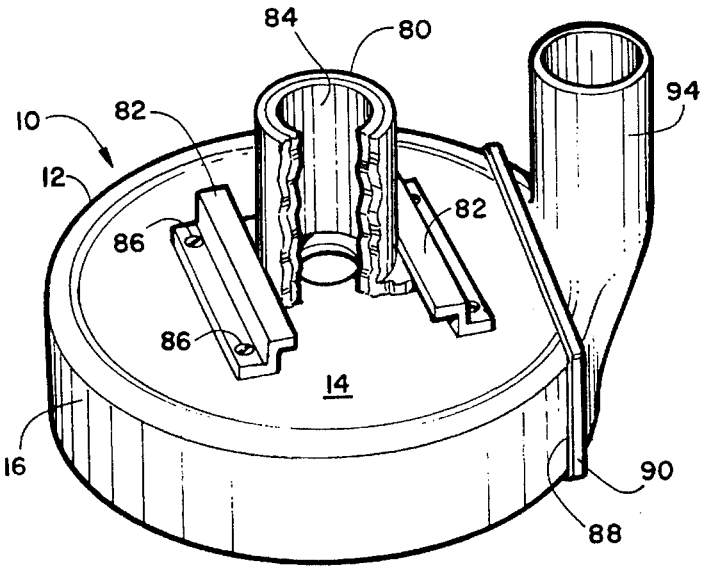
FIG. 5 is a perspective view of a fourth embodiment having an adjustable collar attachment and an exchangeable side mounted exhaust port.

FIG. 5 shows a further embodiment, using a different adjustable collar mounting arrangement and a different exchangeable exhaust system. Here, a partial-circular (preferably from about 30 to 50% of the circumference of a circle) bracket 80, is mounted in channels 82 so as to be slidable toward and away from the center of base 14. Bracket 80 is formed from a flexible material, such as polycarbonate, styrene, acrylic or polypropylene plastics, and may have a resilient, rubbery or foam, layer 84 on the interior. Bracket 80 is brought into contact with a sander or other tool housing similar to housing 22 shown in FIG. 1, and clamped to the housing by a conventional hose clamp or the like. The flexibility of the bracket and any resilient lining will allow the bracket to tightly engage housings of a range of diameters. With shield 10 properly positioned, bracket 80 is secured to channels 82, such as by setscrews 86.

If desired, two assemblies of a bracket 80 and channels 82 can be positioned on opposite sides of the base center to contact opposite sides of a housing, to increase the strength and rigidity of the mounting.

A generally rectangular exhaust port 88 is provided in skirt 16 in the embodiment of FIG. 5. A frame 90 is provided around exhaust port 88 and has grooves 9 (not seen) in the side and bottom edges. Typical of such grooves are those shown in FIGS. 3C and 4A. An exhaust tube 94 having a diameter selected to match a desired vacuum hose (not shown) is mounted on a rectangular adapter having an outer edge sized to slide into grooves 92. Thus, tube 94 can be replaced with another having a different angle (e.g. to accommodate a left-handed operator) or a different diameter to accommodate a different vacuum hose diameter.

Figure 6:
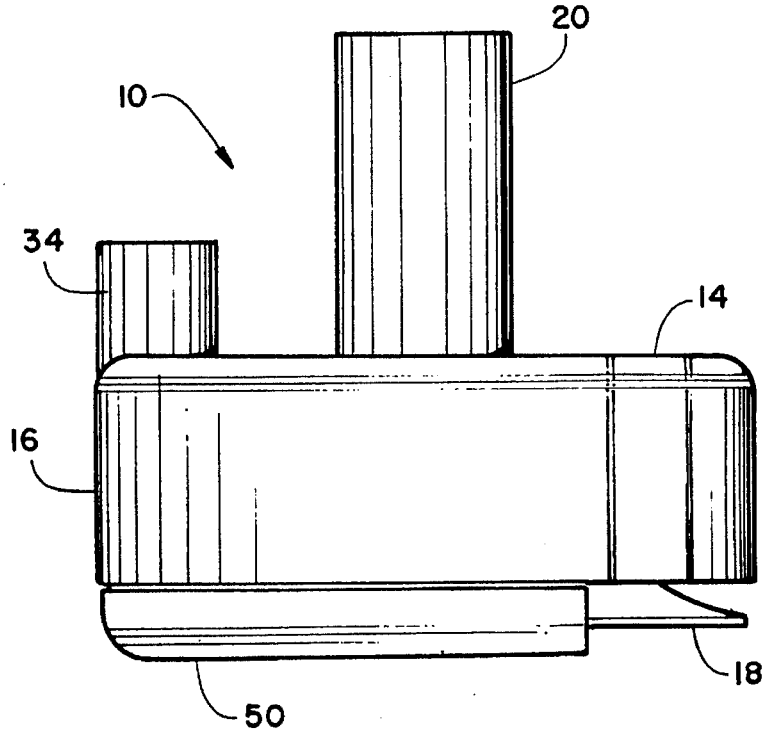
FIG. 6 is a side elevation view of an embodiment particularly adapted to edge grinding and sanding.

FIG. 6 shows an embodiment particularly adapted to edge sanding or grinding. Here, shield 10 can be any of the embodiments shown in FIGS. 1, 2, 4 or 5, above with a base 14, skirt 16, collar 20 and exhaust tube 34. Here the entire skirt 16 is used, but an edge of cover 50 is removed. The edge of grinding tool 18 is exposed for edge grinding. Most of tool 18 is housed, the vacuum being drawn into the shield is focused exclusively on the small exposed area of the abrasive disc, then passes out through tube 34. This arrangement will capture most of the sanding dust. While cover 50 can be secured to skirt 16 in any suitable manner, the bead and groove arrangement shown in FIG. 3C is preferred.

Figure 7:
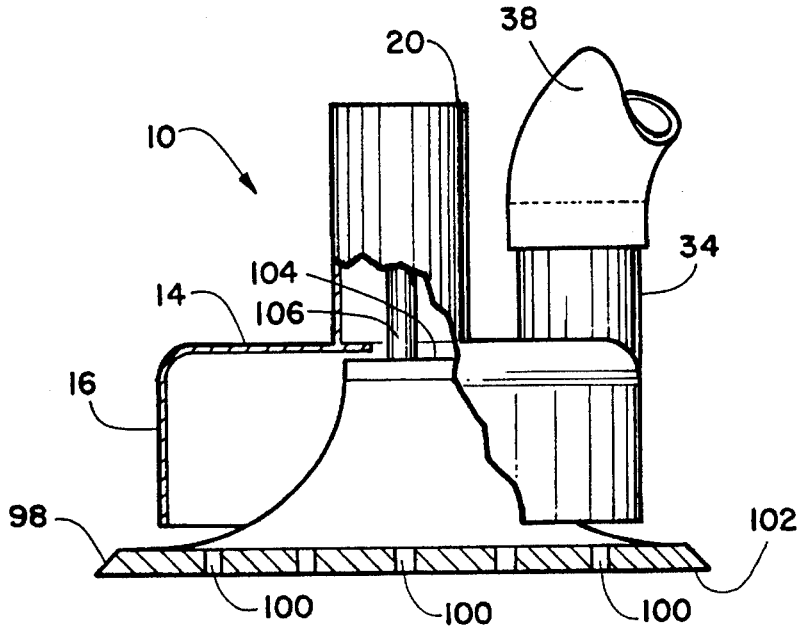
FIG. 7 is a side elevation view, partially cut away, of a fifth embodiment for use with vacuum discs designed for pickup through a holed backup pad and abrasive disc.

FIG. 7 shows a shield arrangement particularly useful with a tool 98 which uses a plurality of holes 100 through bottom surface 102 of the tool to draw abraded debris up through the disc itself by vacuum forces, where the back of the tool is exposed to a low pressure, vacuum, environment. Shield 10 is structurally the same as that shown in FIGS. 1 and 2, except that the diameter of skirt 16 is less than the diameter of tool 98 and greater than the diameter of the ring of holes 100. Tool 98 is carried by a shaft 106 (corresponding to shaft 26 in FIG. 1) which passes through a hole 104 in base 14. A vacuum hose 38 connected to exhaust tube 34 draws dust, etc. through the backup pad and out of shield 10.

The collar configurations allow easy and convenient up and down positioning of the entire shield for use in any combination of power sanders and other tools. If desired, the upper portion of each bracket may have a series of weakened lines similar to lines 40 in planes perpendicular to the shield centerline, so that any end portions of any brackets that interfere with parts of housings when the shield is positioned in upward positions can be broken away. Thus, these collars are adaptable to almost any hand sanding tool.

Of course, the other shield embodiments and exhaust tube embodiments discussed above could be used with tools of the sort shown in FIG. 6 by properly sizing the skirt diameter. In addition a narrow strip of brush material, or other soft material, may be included along the edge of the skirt.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

We claim:

1. A dust control system for rotary hand tools which comprises:

a shroud having an interior and comprising a base secured to a peripheral skirt adapted to surround a rotatable abrasive means;

a central opening in said base for passage of a rotatable tool shaft extending from a substantially cylindrical housing said tool shaft and housing being coaxial;

a partially tubular collar secured in a substantially perpendicular relationship to said base opposite said skirt for contact with said housing, said collar contacting less than the full circumference of said housing and capable of engaging housings of different diameters;

said collar having a partial circular cross section and leaving at least about a 120° segment of the circumference of said housing open and accessible from outside said collar;

means for securely fastening said collar to said housing;

an exhaust tube communicating with the interior of said shroud through an exhaust port.

2. The dust control system for rotary hand tools according to claim 1 wherein said collar comprises an one axial tube section adapted to extend from about 30° to 240° around said housing.

3. The dust control system for rotary hand tools according to claim 2 wherein said axial tube section is integral with said base and further includes a plurality of reinforcements secured between said axial tube section and said base.

4. The dust control system for rotary hand tools according to claim 1 wherein said means for fastening said collar to a housing comprises at least one hose clamp.

5. The dust control system for rotary hand tools according to claim 1 wherein said collar means comprises at least one bracket slidably secured to said base for movement toward and away from the center of said shroud, whereby said bracket may be brought into engagement with said housing.

6. The dust control system for rotary hand tools according to claim 1 wherein said exhaust port is a tubular section secured to said base substantially perpendicular to said base and communicates with an opening through said base.

7. The dust control system for rotary hand tools according to claim 6 further including an angled exhaust extension releasably connected to said exhaust port and adapted to be rotated relative to said shroud about the exhaust tube centerline.

8. The dust control system for rotary hand tools according to claim 1 wherein said exhaust port is releasably secured to said skirt and is in communication with a hole through said skirt.

9. The dust control system for rotary hand tools according to claim 1 wherein said shroud base and skirt have at least one weakened line lying substantially perpendicular to a line drawn through the center of the shroud base whereby the portion of the shroud outside the line can be easily removed to permit the edge of a rotating abrasive means to extend beyond the shroud.

10. The dust control system for rotary hand tools according to claim 1 further including a cover releasably attachable to the edge of said skirt opposite said base.

11. The dust control system for rotary hand tools according to claim 10 wherein said cover includes at least one weakened line corresponding to the shroud base and skirt weakened line whereby a portion of the cover outside the line can be easily removed.

12. A dust control system for rotary hand tools which comprises:

a shroud having an interior and comprising a base secured to a peripheral skirt adapted to surround a rotatable abrasive means;

a central opening in said base for passage of a rotatable tool shaft extending from a substantially cylindrical housing;

a collar secured to said base opposite said skirt for engaging a cylindrical housing, said collar consisting of a single axial circular tube section extending a radial distance corresponding to from about 30° to 240° around the circular tube axis and capable of engaging housings of a range of diameters; and an exhaust tube communicating with the interior of said shroud through an exhaust port.

13. The dust control system for rotary hand tools according to claim 12 further including a layer of resilient material on the interior of said collar for contacting said housing.

14. The dust control system for rotary hand tools according to claim 12 further including at least one reinforcing gusset secured to said base and said collar adjacent to said base.

15. The dust control system for rotary hand tools according to claim 12 further including means for fastening said collar to a housing comprising at least one hose clamp.

16. A dust control system for rotary hand tools which comprises:

a shroud having an interior and comprising a base and a peripheral skirt adapted to surround a rotatable abrasive means;

a central opening in said base for passage of a rotatable tool shaft extending from a substantially cylindrical housing;

at least one bracket slidably secured to said base on the side opposite said skirt for movement toward and away from the center of said shroud, whereby said bracket may be brought into engagement with said housing;

means for securely fastening said bracket to said housing; and an exhaust tube communicating with the interior of said shroud through an exhaust port.

17. The dust control system for rotary hand tools according to claim 16 wherein no more than two spaced brackets are provided and further including means for locking said brackets to said base.

18. The dust control system for rotary hand tools according to claim 16 wherein at least three spaced brackets are provided.

19. The dust control system for rotary hand tools according to claim 16 further including means for fastening said collar to a housing comprising at least one hose clamp.

20. The dust control system for rotary hand tools according to claim 16 wherein said shroud base and skirt have at least one weakened line lying substantially perpendicular to a line drawn through the center of the shroud base whereby the portion of the shroud outside the line can be easily removed to permit the edge of a rotating abrasive means to extend beyond the shroud.

21. The dust control system for rotary hand tools according to claim 16 wherein said shroud includes at least one weakened line corresponding to the shroud base and skirt weakened line whereby a portion of the shroud outside the line can be easily removed.

* * * * *